US008185290B2

(12) United States Patent
Mintah et al.

(10) Patent No.: US 8,185,290 B2
(45) Date of Patent: May 22, 2012

(54) DATA ACQUISITION SYSTEM INDEXED BY CYCLE SEGMENTATION

(75) Inventors: Brian Mintah, Washington, IL (US); Robert J. Price, Dunlap, IL (US); Kevin D. King, Peoria, IL (US); Vijayakumar Janardhan, Washington, IL (US); Shoji Tozawa, Kobe (JP)

(73) Assignee: Caterpillar Inc., Peoria, IL (US)

( * ) Notice: Subject to any disclaimer, the term of this patent is extended or adjusted under 35 U.S.C. 154(b) by 509 days.

(21) Appl. No.: 12/073,669

(22) Filed: Mar. 7, 2008

(65) Prior Publication Data

US 2009/0228176 A1 Sep. 10, 2009

(51) Int. Cl.
*G06F 19/00* (2006.01)

(52) U.S. Cl. ..... 701/99; 701/50; 37/379; 172/3

(58) Field of Classification Search ..... 701/99–115
See application file for complete search history.

(56) References Cited

U.S. PATENT DOCUMENTS

| | | | | |
|---|---|---|---|---|
| 4,035,621 | A | | 7/1977 | Kemp |
| 4,805,086 | A | | 2/1989 | Nielsen et al. |
| 4,945,221 | A | | 7/1990 | Nielsen et al. |
| 4,995,468 | A | | 2/1991 | Fukuda |
| 5,105,896 | A | | 4/1992 | Kyrtsos |
| 5,220,968 | A | | 6/1993 | Weber |
| 5,261,495 | A | | 11/1993 | Szymczak |
| 5,268,834 | A | | 12/1993 | Sanner et al. |
| 5,274,557 | A | | 12/1993 | Moriya et al. |
| 5,357,424 | A | | 10/1994 | Kakizaki et al. |
| 5,438,771 | A | | 8/1995 | Sahm et al. |
| 5,446,980 | A | | 9/1995 | Rocke |
| 5,493,798 | A | | 2/1996 | Rocke et al. |
| 5,509,293 | A | | 4/1996 | Karumanchi |
| 5,612,864 | A | | 3/1997 | Henderson |
| 5,659,470 | A | * | 8/1997 | Goska et al. ..... 701/35 |
| 5,682,312 | A | | 10/1997 | Rocke |
| 5,714,719 | A | | 2/1998 | Otsuka et al. |
| 5,764,511 | A | | 6/1998 | Henderson |
| 5,824,965 | A | | 10/1998 | Fujii et al. |
| 5,880,408 | A | | 3/1999 | Schreiner |
| 5,925,085 | A | | 7/1999 | Kleimenhagen et al. |
| 5,953,838 | A | | 9/1999 | Steenwyk |

(Continued)

FOREIGN PATENT DOCUMENTS

JP 2004-114081 A * 4/2004

(Continued)

*Primary Examiner* — Jack W Keith
*Assistant Examiner* — Adam Tissot
(74) *Attorney, Agent, or Firm* — Finnegan, Henderson, Farabow, Garrett & Dunner LLP

(57) ABSTRACT

A data acquisition system for an excavation machine having a power source configured to drive a tool through a work cycle is disclosed. The data acquisition system may have a first sensor associated with the power source to generate a first signal indicative of a performance of the power source, and a second sensor associated with the tool to generate a second signal indicative of a performance of the tool. The data acquisition system may also have a controller in communication with the first and second sensors. The controller may be configured to record the first and second signals, and partition the work cycle into a plurality of segments. The controller may be further configured to link the performance of the power source and the performance of the tool together with one of the plurality of segments during which the associated first and second signals were recorded.

20 Claims, 5 Drawing Sheets

U.S. PATENT DOCUMENTS 5,955,706 A 9/1999 Fonkalsrud et al.
5,968,103 A * 10/1999 Rocke ..... 701/50
6,076,030 A * 6/2000 Rowe ..... 701/50
6,114,993 A 9/2000 Henderson et al.
6,211,471 B1 4/2001 Rocke et al.
6,234,254 B1 * 5/2001 Dietz et al. ..... 172/3
6,363,632 B1 * 4/2002 Stentz et al. ..... 37/414
6,518,519 B1 2/2003 Crane, III et al.
6,552,279 B1 * 4/2003 Lueschow et al. ..... 177/141
6,601,013 B2 7/2003 Lueschow et al.
6,691,010 B1 2/2004 Gay
6,845,311 B1 1/2005 Stratton et al.
6,858,809 B2 2/2005 Bender
6,934,616 B2 8/2005 Colburn et al.
7,003,386 B1 2/2006 Ericsson et al.
7,079,931 B2 7/2006 Sahm et al.
7,276,669 B2 10/2007 Dahl et al.
7,533,527 B2 * 5/2009 Naruse ..... 60/433
2005/0267713 A1 12/2005 Horkavi et al.
2006/0124323 A1 6/2006 Glover et al.
2007/0021895 A1 1/2007 Brandt et al.

FOREIGN PATENT DOCUMENTS

JP 2004-114081 A * 4/2004

* cited by examiner

DATA ACQUISITION SYSTEM INDEXED BY CYCLE SEGMENTATION

TECHNICAL FIELD

The present disclosure relates generally to a data acquisition system, and more particularly, to a data acquisition system that is indexed by work cycle segmentation.

BACKGROUND

Excavation machines are often equipped with sensors for measuring various operating conditions of the machines. These operating conditions can include, for example, engine RPM, oil pressure, water temperature, boost pressure, oil contamination levels, electric motor current, hydraulic pressures, system voltage, fuel consumption, payload, ground speed, transmission ratio, cycle time, global position, and the like. A data acquisition system can be provided on each machine for receiving the operating conditions, processing data, and generating an operating condition database for subsequent evaluation of machine performance.

One such data acquisition system is disclosed in U.S. Patent Publication No. 2005/0267713 (the '713 publication) by Horkavi et al. published Dec. 1, 2005. Specifically, the '713 publication discloses a data acquisition system for a work machine that has at least one sensor disposed on the work machine. The at least one sensor is configured to produce a signal indicative of an operating parameter of the work machine. The data acquisition system also has an identification module disposed on the work machine and configured to receive an input corresponding to a machine operator. The data acquisition system further has a controller disposed on the work machine and in communication with the at least one sensor and the identification module. The controller is configured to record and link the signal and the input. The data acquisition system additional has a communication module disposed on the work machine and in communication with the controller. The communication module is configured to transfer the recorded and linked signal and input from the controller to an off-board system.

In one example, the sensor of the '713 publication is associated with a power source and a work implement to generate signals indicative of fuel consumption and payload. The fuel consumption and payload information is directed to the controller, which indexes the information according to the operator controlling the work machine at the time the information is recorded. The controller also generates and maintains a time of day and date associated with the recorded information. In this manner, post-processing of the recorded and indexed information may be performed to determine how performance of the work machine varied during a particular work shift according to the operator that was controlling the machine.

Although the data acquisition system of the '713 publication may record and post-process some machine performance parameters, the usefulness of the information generated by the system may be limited. That is, the data is only indexed according to operator identification and/or time, and other important indexing parameters such as cycle segmentation may be neglected.

The disclosed system is directed to overcoming one or more of the problems set forth above.

SUMMARY

One aspect of the present disclosure is directed to a data acquisition system for an excavation machine having a power source configured to drive a tool through a work cycle. The data acquisition system may include a first sensor associated with the power source to generate a first signal indicative of a performance of the power source, and a second sensor associated with the tool to generate a second signal indicative of a performance of the tool. The data acquisition system may also include a controller in communication with the first and second sensors. The controller may be configured to record the first and second signals, and partition the work cycle into a plurality of segments. The controller may be further configured to link the performance of the power source and the performance of the tool together with one of the plurality of segments during which the associated first and second signals were recorded.

Another aspect of the present disclosure is directed to a method of acquiring data. The method may include generating a power output, sensing a first performance parameter associated with generation of the power output, directing the power output to complete an excavation work cycle, and sensing a second performance parameter associated with completion of the excavation work cycle. The method may also include recording the first and second performance parameters, and partitioning the excavation work cycle into a plurality of segments. The method may further include linking the first and second performance parameters together with one of the plurality of segments during which the associated first and second performance parameters were recorded.

DETAILED DESCRIPTION

Figure 1:
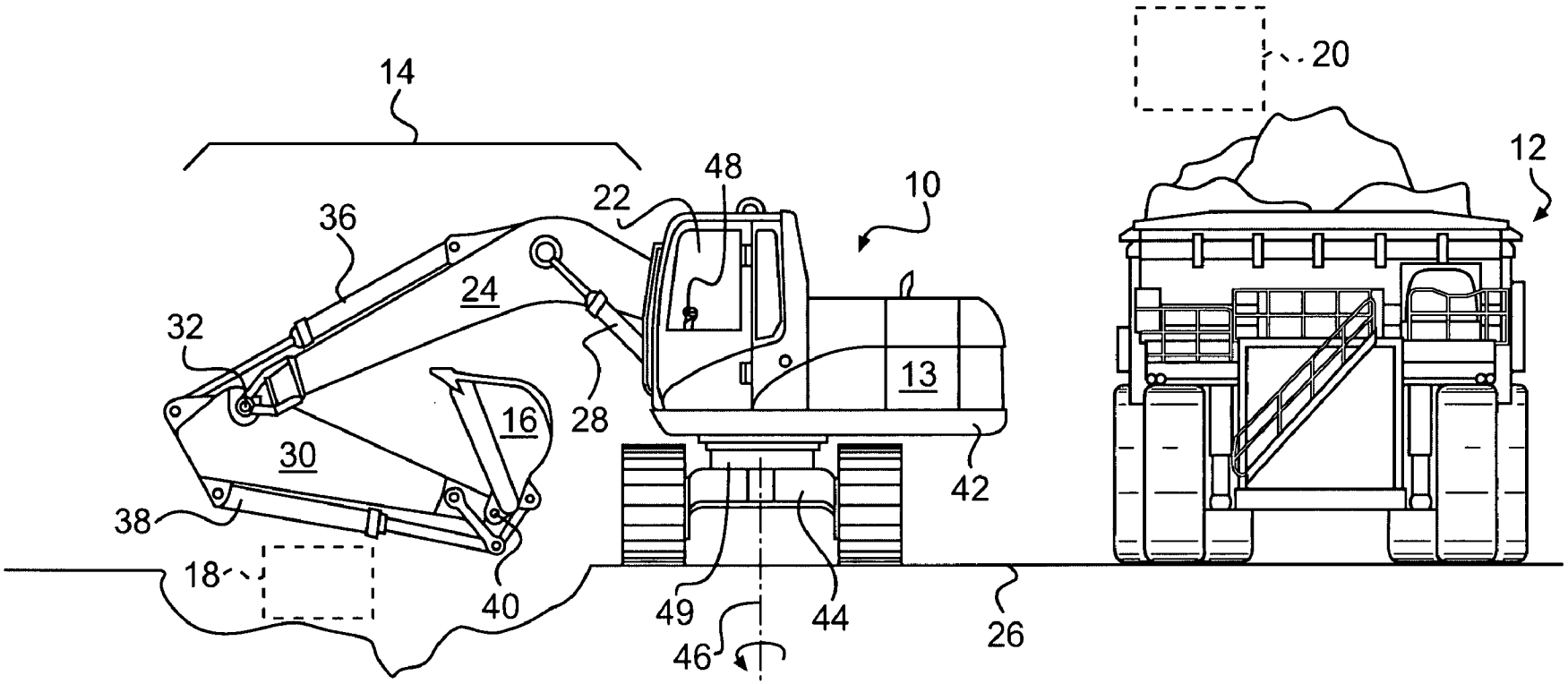
FIG. 1 is a diagrammatic illustration of an exemplary disclosed machine.

FIG. 1 illustrates an exemplary machine 10 having multiple systems and components that cooperate to excavate and load earthen material onto a nearby haul vehicle 12. In one example, machine 10 may embody a hydraulic excavator. It is contemplated, however, that machine 10 may embody another type of excavation machine such as a backhoe, a front shovel, a dragline excavator, or another similar machine. Machine 10 may include, among other things, a power source 13 configured to produce a power output, an implement system 14 driven by the power output to move a work tool 16 between a dig location 18 within a trench and a dump location 20 over haul vehicle 12, and an operator station 22 for manual control of power source 13 and/or implement system 14.

Power source 13 may embody a combustion engine such as, for example, a diesel engine, a gasoline engine, a gaseous fuel-powered engine, or any other engine apparent to one skilled in the art. Alternatively, power source 13 may embody a non-combustion source of power such as a battery, a fuel cell, or a motor, if desired. The output of power source 13 may be directed to pressurize hydraulic fluid used to move implement system 14.

Implement system 14 may include a linkage structure acted on by fluid actuators to move work tool 16. Specifically, implement system 14 may include a boom member 24 vertically pivotal relative to a work surface 26 by a pair of adjacent, double-acting, hydraulic cylinders 28 (only one shown in FIG. 1). Implement system 14 may also include a stick member 30 vertically pivotal about a horizontal axis 32 by a single, double-acting, hydraulic cylinder 36. Implement system 14 may further include a single, double-acting, hydraulic cylinder 38 operatively connected to work tool 16 to pivot work tool 16 vertically about a horizontal pivot axis 40. Boom member 24 may be pivotally connected to a frame 42 of machine 10. Frame 42 may be pivotally connected to an undercarriage member 44, and swung about a vertical axis 46 by a swing motor 49. Stick member 30 may pivotally connect boom member 24 to work tool 16 by way of pivot axes 32 and 40. It is contemplated that a greater or lesser number of fluid actuators may be included within implement system 14 and connected in a manner other than described above, if desired.

Numerous different work tools 16 may be attachable to a single machine 10 and controllable via operator station 22. Work tool 16 may include any device used to perform a particular task such as, for example, a bucket, a fork arrangement, a blade, a shovel, or any other task-performing device known in the art. Although connected in the embodiment of FIG. 1 to pivot and swing relative to machine 10, work tool 16 may alternatively or additionally rotate, slide, or move in any other manner known in the art.

Operator station 22 may be configured to receive input from a machine operator indicative of a desired work tool movement. Specifically, operator station 22 may include one or more operator input devices 48 embodied as single or multi-axis joysticks located proximal an operator seat (not shown). Operator input devices 48 may be proportional-type controllers configured to position and/or orient work tool 16 by producing a work tool position signal that is indicative of a desired work tool speed and/or force in a particular direction. The position signal may be used to actuate any one or more of hydraulic cylinders 28, 36, 38 and/or swing motor 49. It is contemplated that different operator input devices may alternatively or additionally be included within operator station 22 such as, for example, wheels, knobs, push-pull devices, switches, pedals, and other operator input devices known in the art. It is also contemplated that operator station 22 may include an interface device (not shown) for use in receiving operator instructions and/or displaying machine performance information, if desired.

Figure 2:
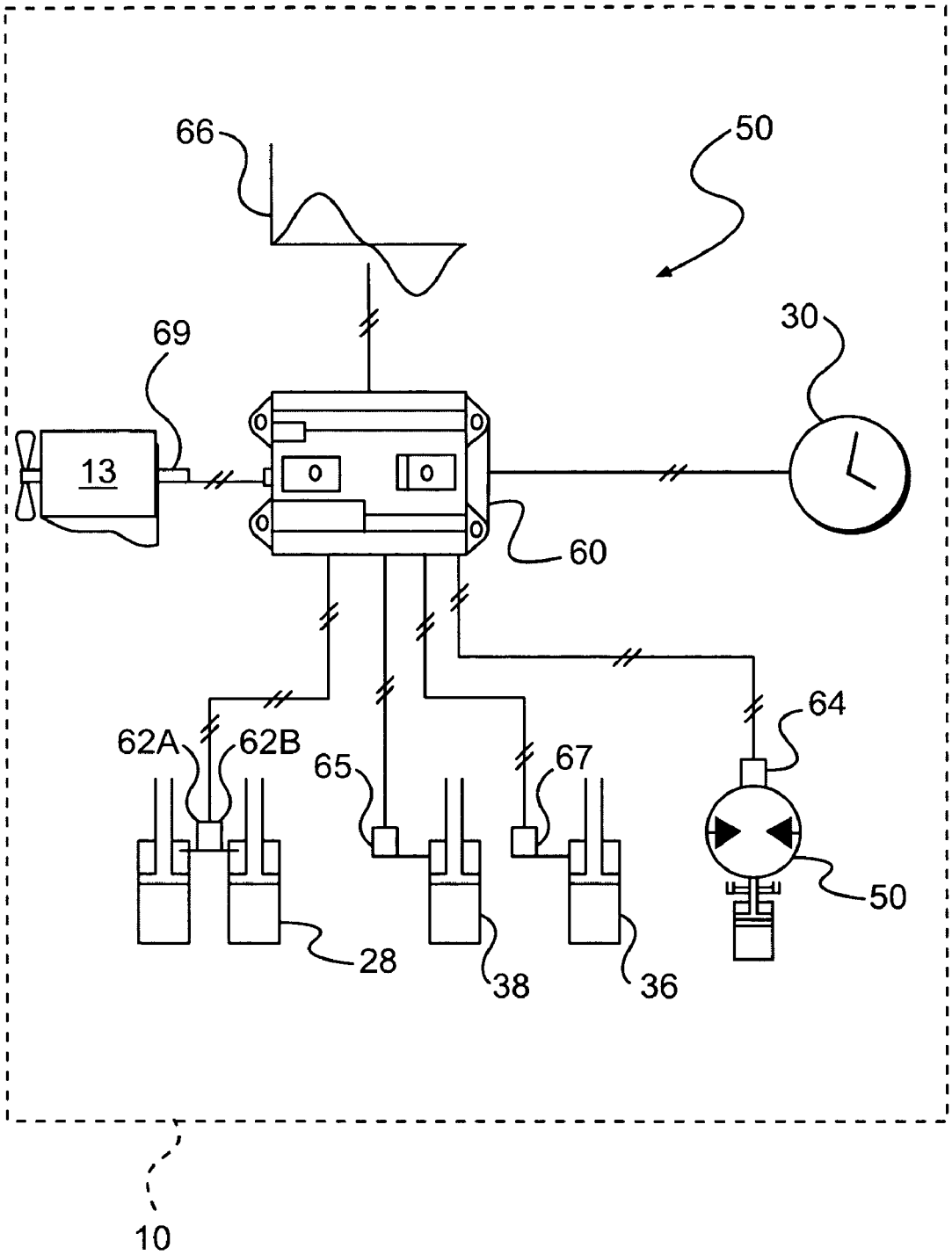
FIG. 2 is a schematic illustration of an exemplary disclosed data acquisition system that may be used with the machine of FIG. 1.

As illustrated in FIG. 2, machine 10 may include a data acquisition system 50 configured to monitor, record, and/or control movements of work tool 16 (referring to FIG. 1). In particular, hydraulic data acquisition system 50 may include a controller 60 in communication with a plurality of sensors. In one embodiment, controller 60 may be in communication with a first boom sensor 62A, a second boom sensor 62B, a swing sensor 64, a bucket sensor 65, a stick sensor 67, and a power source sensor 69. Based on input received from these sensors, controller 60 may be configured to partition a typical work cycle performed by machine 10 into a plurality of segments, for example, into a dig segment, a swing-to-truck segment (i.e., a loaded swing segment), a dump segment, and a swing-to-trench segment (i.e., an empty swing segment); to monitor a payload during a selected one of these segments; to monitor and analyze the performance of power source 13; and/or to display the performance machine 10 as will be described in more detail below.

Controller 60 may embody a single microprocessor or multiple microprocessors that include a means for performing an operation of data acquisition system 50. Numerous commercially available microprocessors can be configured to perform the functions of controller 60. It should be appreciated that controller 60 could readily embody in a general machine microprocessor capable of controlling numerous machine functions. Controller 60 may include a memory, a secondary storage device, a processor, and any other components for running an application. Various other circuits may be associated with controller 60 such as power supply circuitry, signal conditioning circuitry, solenoid driver circuitry, and other types of circuitry.

One or more maps 66 relating signals from sensors 62A, 62B, 64, 65, and 67 to the different segments of the typical excavation work cycle may be stored within the memory of controller 60. Each of these maps may include a collection of data in the form of tables, graphs, and/or equations. In one example, threshold speeds associated with the start and/or end of one or more of the segments may be stored within the maps. In another example, threshold forces associated with the start and/or end of one or more of the segments may be stored within the maps. In yet another example, a speed and/or a force of work tool 16 may be recorded into the maps throughout each excavation work cycle and subsequently analyzed by controller 60 during partitioning of the excavation work cycle. Controller 60 may be configured to allow the operator of machine 10 to directly modify these maps and/or to select specific maps from available relationship maps stored in the memory of controller 60 to affect cycle partitioning and/or payload monitoring. It is contemplated that the maps may additionally or alternatively be automatically selectable based on modes of machine operation, if desired.

First boom sensor 62A may be associated with the vertical pivoting motion of work tool 16 imparted by hydraulic cylinders 28 (i.e., associated with the lifting and lowering motions of boom member 24 relative to frame 42). Specifically, first boom sensor 62A may be an angular position or speed sensor associated with a pivot joint between boom member 24 and frame 42, a displacement sensor associated with hydraulic cylinders 28, a local or global coordinate position or speed sensor associated with any linkage member connecting work tool 16 to frame 42 or with work tool 16 itself, a displacement sensor associated with movement of operator input device 48, or any other type of sensor known in the art that may generate a signal indicative of a pivoting position or speed of machine 10. This signal may be sent to controller 60 throughout each excavation cycle. It is contemplated that controller 60 may derive a pivot speed based on a position signal from first boom sensor 62A and an elapsed period of time, if desired.

Second boom sensor 62B may be associated with the vertical pivoting force of work tool 16 imparted by hydraulic cylinders 28 (i.e., associated with the lift force of boom member 24 relative to frame 42). Specifically, second boom sensor 62B may be a pressure sensor associated with hydraulic cylinders 28 used to determine a force thereof based on a measured pressure or pressure differential, a strain gauge associated with the connection of boom member 24 to frame 42, a type of load cell, or any other device known in the art for monitoring a force and generating a signal in response thereto. This signal may be sent to controller 60 throughout each excavation cycle.

Swing sensor 64 may be associated with the generally horizontal swinging motion of work tool 16 imparted by swing motor 49 (i.e., the motion of frame 42 relative to undercarriage member 44). Specifically, swing sensor 64 may be a rotational position or speed sensor associated with the operation of swing motor 49, an angular position or speed sensor associated with the pivot connection between frame 42 and undercarriage member 44, a local or global coordinate position or speed sensor associated with any linkage member connecting work tool 16 to undercarriage member 44 or with work tool 16 itself, a displacement sensor associated with movement of operator input device 48, or any other type of sensor known in the art that may generate a signal indicative of a swing position or speed of machine 10. This signal may be sent to and recorded by controller 60 throughout each excavation cycle. It is contemplated that controller 60 may alternatively derive a swing speed based on a position signal from swing sensor 64 and an elapsed period of time, if desired.

Bucket sensor 65 may be associated with the pivoting force of work tool 16 imparted by hydraulic cylinder 38. Specifically, bucket sensor 65 may be a pressure sensor associated with one or more chambers within hydraulic cylinder 38, a strain gauge associated with the pivot connection between work tool 16 and stick member 3, a load cell, or any other type of sensor known in the art that generates a signal indicative of a pivoting force of machine 10 during a dig and a dump operation of work tool 16. This signal may be sent to controller 60 throughout each excavation cycle.

Stick sensor 67 may be associated with the vertical pivoting force of work tool 16 imparted by hydraulic cylinder 36 (i.e., associated with the lift force of stick member 30 relative to boom member 24). Specifically, second stick sensor 67 may be a pressure sensor associated with hydraulic cylinder 36 used to determine a force thereof based on a measured pressure or pressure differential, a strain gauge associated with the connection of stick member 30 to boom member 24, a type of load cell, or any other device known in the art for monitoring a force and generating a signal in response thereto. This signal may be sent to controller 60 throughout each excavation cycle.

Power source sensor 69 may be associated with power source 13 to monitor a performance thereof. In one embodiment, power source sensor 69 may embody a fuel consumption sensor configured to generate a signal indicative of an amount of fuel being consumed by power source 13. In another embodiment, power source sensor 69 may embody a speed sensor, a temperature sensor, a torque sensor, or any other sensor known in the art. It is contemplated that multiple power source sensors 69 may be included within machine 10, if desired. The signal(s) from power source sensor 69 may be directed to controller 60 throughout operation of machine 10.

Figure 3:
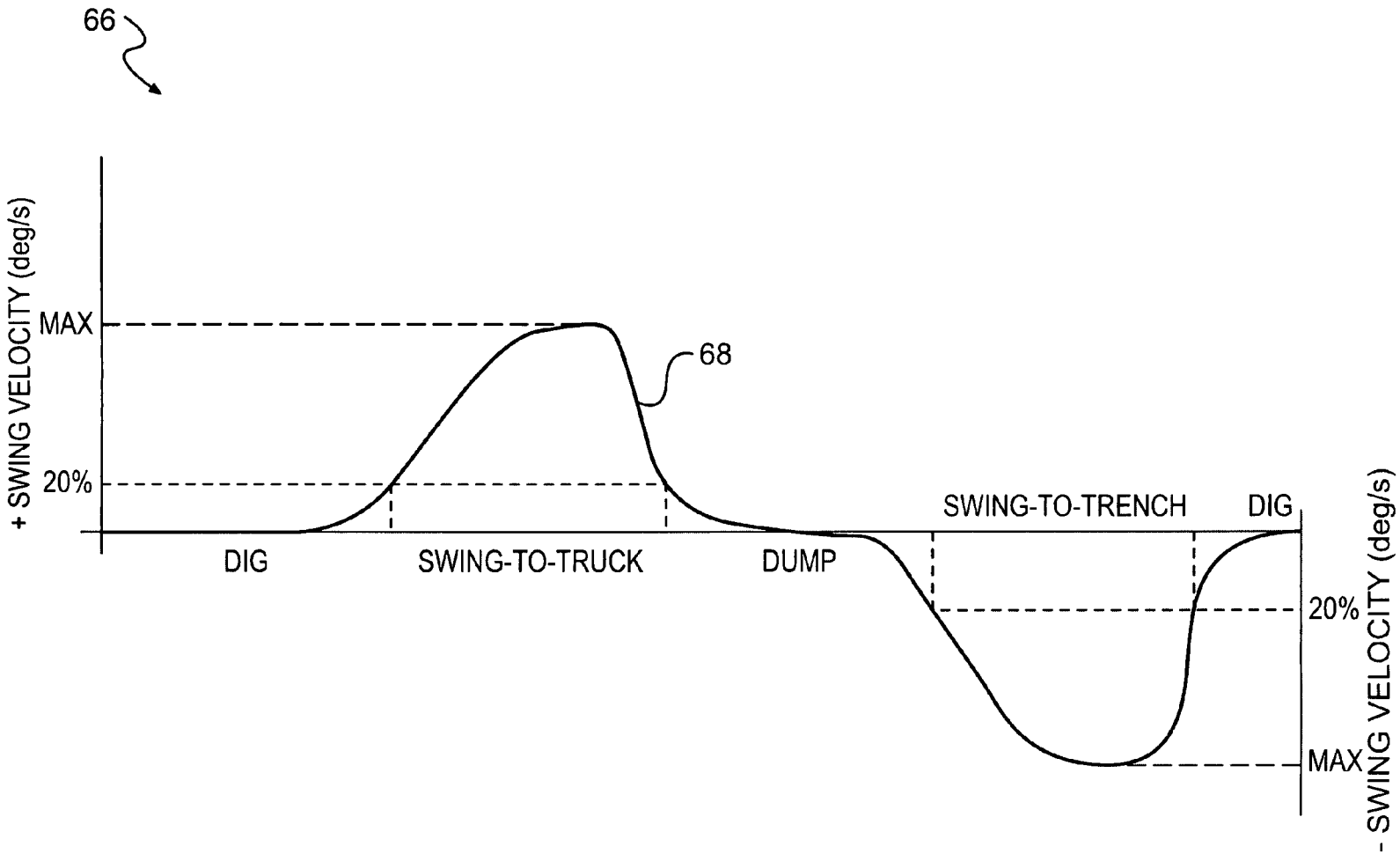
FIG. 3 is an exemplary disclosed control map that may be used by the data acquisition system of FIG. 2.

With reference to FIG. 3, a curve 68 may represent the swinging speed of machine 10 throughout each segment of the excavation work cycle, as recorded by controller 60 based on signals received from sensor 64. During most of the dig segment, the swing speed may typically be about zero (i.e., machine 10 may generally not swing during a digging operation). At completion of a dig stroke, machine 10 may generally be controlled to swing work tool 16 toward the waiting haul vehicle 12 (referring to FIG. 1). As such, the swing speed of machine 10 may begin to increase toward the end of the dig segment. As the swing-to-truck segment of the excavation work cycle progresses, the swing speed may reach a maximum when work tool 16 is about midway between dig location 18 and dump location 20, and then slow toward the end of the swing-to-truck segment. During most of the dump segment, the swing speed may typically be about zero (i.e., machine 10 may generally not swing during a dumping operation). When dumping is complete, machine 10 may generally be controlled to swing work tool 16 back toward dig location 18 (referring to FIG. 1). As such, the swing speed of machine 10 may begin to increase toward the end of the dump segment. As the swing-to-trench segment of the excavation cycle progresses, the swing speed may reach a maximum in a direction opposite to the swing direction of the swing-to-truck segment. This maximum speed may generally be achieved when work tool 16 is about midway between dump location 20 and dig location 18. The swing speed of work tool 16 may then slow toward the end of the swing-to-trench segment, as work tool 16 nears dig location 18.

Controller 60 may partition a current excavation work cycle into the four segments described above based on signals received from sensors 62A, 64, and 65, and with reference to the swing speeds and pivot forces of machine 10 recorded for a previous excavation work cycle (i.e., with reference to curve 68 within map 66). Typically, controller 60 may partition the excavation work cycle based on at least three different conditions being satisfied, one condition associated with the swing motion measured by sensor 62A, one condition associated with the pivoting motion measured by sensor 64, and one condition associated with the pivot force measured by sensor 65. For example, controller 60 may partition the current excavation work cycle between the dig segment and the swing-to-truck segment when a current swing speed of machine 10 exceeds an amount of the maximum swing speed recorded during the previous swing-to-truck segment, when the pivot speed exceeds a threshold speed value, and when the pivot force is less than a threshold value. In one example, the amount may be about 20% of the maximum swing speed recorded during the previous swing-to-truck segment, while the threshold speed value may be about 5°/sec. The threshold pivot force may vary based on a size of machine 10 and an application thereof. It is also contemplated that the threshold pivot force, similar to the swing speed, may be based on the maximum force generated during a previously recorded cycle, if desired.

The excavation work cycle may be partitioned between the swing-to-truck segment and the dump segment in a manner similar to that described above. In particular, controller 60 may partition the current excavation work cycle between the swing-to-truck segment and the dump segment when a current swing speed of machine 10 slows to less than about 20% of the maximum swing speed recorded during the previous swing-to-truck segment, when the pivot speed slows to less than about 5°/sec, and when the pivot force exceeds a threshold value.

In contrast to the dig and swing-to-truck segments, the dump segment may be considered complete based on a current swing speed, a current pivot direction, and a pivot force, regardless of pivot speed. That is, controller 60 may partition the excavation work cycle between the dump segment and the swing-to-trench segment when a current swing speed of machine 10 exceeds about 20% of the maximum swing speed recorded during the previous swing-to-trench segment, when the pivot direction is toward dig location 18 (i.e., in a direction opposite from the pivot direction of the swing-to-truck segment or in the same direction as the pull of gravity), and when the pivot force is less than a threshold value. It should be noted that, although shown as a negative speed by curve 68, this negative aspect of the swing speed is simply intended to indicate a direction of the swing speed in opposition to the swing direction encountered during the swing-to-truck segment. In some situations, the maximum swing speeds of the swing-to-truck and swing-to-trench segments may have substantially the same magnitude.

Controller 60 may partition the swing-to-trench segment from the dig segment when a current swing speed of machine 10 slows to less than about 20% of the maximum swing speed recorded during the previous swing-to-trench segment, when the pivot speed is less than about 5°/sec, and when the pivot force is greater than a threshold amount. After this partition has been made, controller 60 may repeat the process with the next excavation work cycle that has already been recorded.

In some situations, it may be beneficial to index each excavation work cycle and/or each segment of each excavation work cycle according to an elapsed period of time or a particular time of the occurrence. In these situations, data acquisition system 50 may include a timer 70 (referring to FIG. 2) in communication with controller 60. Controller 60 may be configured to receive signals from timer 70, and record performance information associated therewith. For example, controller 60 may be configured to record a total number of cycles completed within a user defined period of time, a time required to complete each cycle, a number of segments completed during the user defined period of time, a time to complete each segment, an occurrence time of each cycle, an occurrence time of each segment of each cycle, etc. Each work cycle may be considered completed after the occurrence and detection of each dump segment. This information may be utilized to determine a productivity and/or efficiency of machine 10.

Controller 60 may also be configured to dynamically determine a payload of work tool 16 based on signals from second boom sensor 62B, swing sensor 64, and stick sensor 67, and based on the partitioned work cycle. In particular, after partitioning the work cycle into the four segments described above, controller 60 may select the swing-to-truck segment (i.e., the loaded swing segment) for payload determination. By selecting the swing-to-truck segment for payload determination, controller 60 may help ensure that all of the material that will be loaded into work tool 16 has already been loaded (i.e., that the dig segment is complete), and that no material has been intentionally lost (i.e., that the dump segment has not yet been completed) prior to the determination. Controller 60 may then determine a sampling period within the swing-to-truck segment that may provide the most accurate payload determination.

The sampling period may be a period of time within the swing-to-truck segment when the velocities of work tool 16 are substantially constant (e.g., when the swing velocity changes the least). As can be seen from curve 68, the swing velocity may peak at a point about halfway through the swing-to-truck segment, and the sampling period may be generally positioned about this point of maximum velocity. The sampling period may generally start and end at about the same velocities (i.e., the bounds of the sampling period may be associated with about the same velocity), and have a duration that varies based on the peak swing speed and a quality of payload samples taken during the sampling period. In one embodiment, the velocities at the start and end of the sampling period may be about 15 degrees/sec, and the number of quality payload samples required to accurately determine the payload of work tool 16 may be about 100.

Controller 60 may qualify each payload sample based on a predefined criteria. That is, although controller 60 may continuously sample the force signals from sensors 62B and 67 and the velocity signals from sensors 62A and 64, through post-processing after completion of the work cycle, controller 60 may only use those samples that meet the predefined criteria. In this manner, accuracy of the payload determination may be ensured. Thus, the sampling period may vary in duration, and the start and end velocities bounding the sampling period may change based on the total number of samples within the period required to produce 100 qualified samples. The predefined criteria may be associated with a number of directional changes of work tool 16 requested by an operator of machine 10, a velocity stability of boom member 24 and stick member 30, an extension status of hydraulic cylinders 28 and 36, and an amount of material spillage from work tool 16 during the sampling period. In one example, no directional changes may be requested or implemented during a qualified sample. In another example, the velocity of boom member 24 and stick member 30 must remain constant within a threshold amount during the qualified sample. In yet another example, hydraulic cylinders 28 and 36 may not be at an end stop during the qualified sample, or transitioning from a static friction condition. In a further example, the material spillage from work tool 16 must be less than a threshold amount during the qualified sample. The threshold amounts may vary and be based on a particular machine or application. Each sample taken by controller 60 that meets these criteria may be considered a qualified sample, and be used for payload determination.

Controller 60 may utilized the qualified samples to determine payload by reference to one or more maps stored within the memory of controller 60. Specifically, these maps may relate signals from sensors 62A, 62B, 64, and 67 that have passed the quality criteria outlined above to a payload of work tool 16. Each of these maps may include a collection of data in the form of tables, graphs, and/or equations. In one example, a force related value calculated as an function of the signals received from one or both of sensors 62B and 67, and a speed related value calculated as a function of signals from one or both of sensors 62A and 64 may be related to a payload value in the maps. In one embodiment, the function utilized to calculate the force related value may be an averaging function that takes into account the 100 qualified samples obtained during the sampling period. Similarly, the function utilized to calculate the velocity related value may be an averaging function that takes into account the 100 qualified samples obtained during the sampling period.

It is contemplated that, as machine 10 ages, is serviced or repaired, or components thereof are replaced, controller 60 may require calibration to help ensure accuracy in payload determination. In one embodiment, calibration can be performed in-situ during a normal work cycle. That is, calibration may be performed during the swing-to-trench segment of the work cycle when work tool 16 is substantially empty. The calibration may be performed by determining a payload during the empty swing segment, and comparing the determined payload to the known weight of work tool 16 stored in memory of controller 60. Alternatively or additionally, a known weight may be loaded into work tool 16 during the calibration process and used for comparison, if desired.

Figure 4:
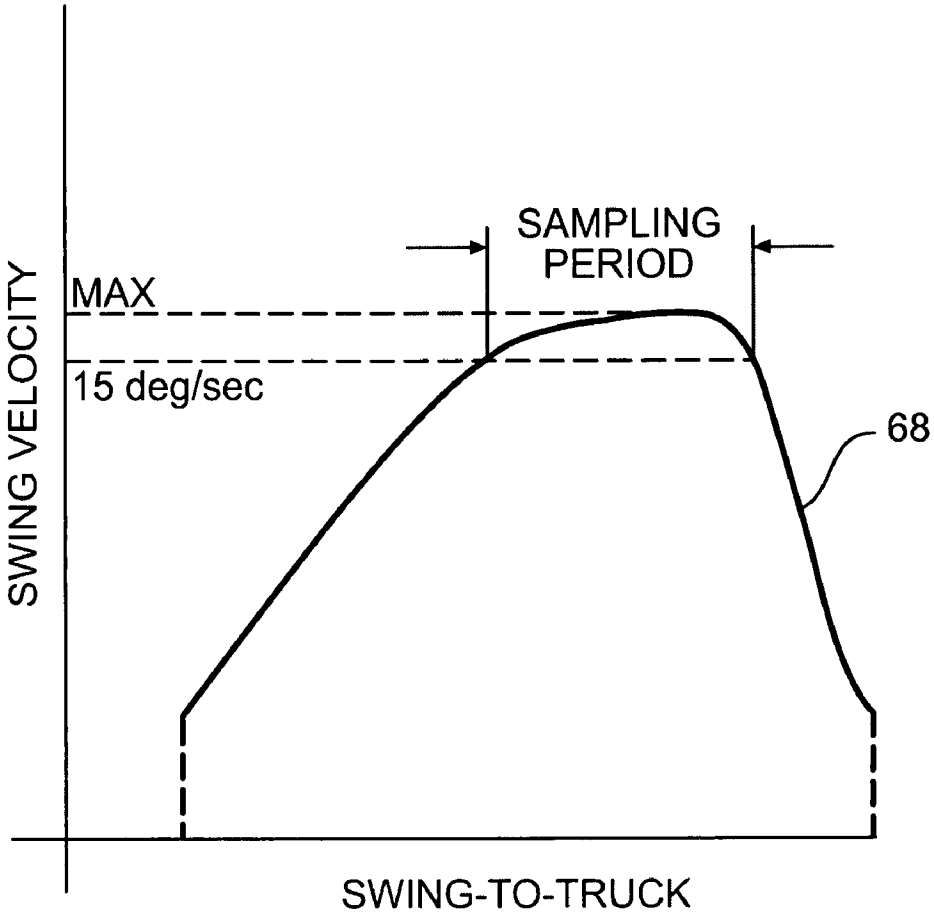
FIG. 4 is an exemplary portion of the control map illustrated in FIG. 3.
Figure 5:
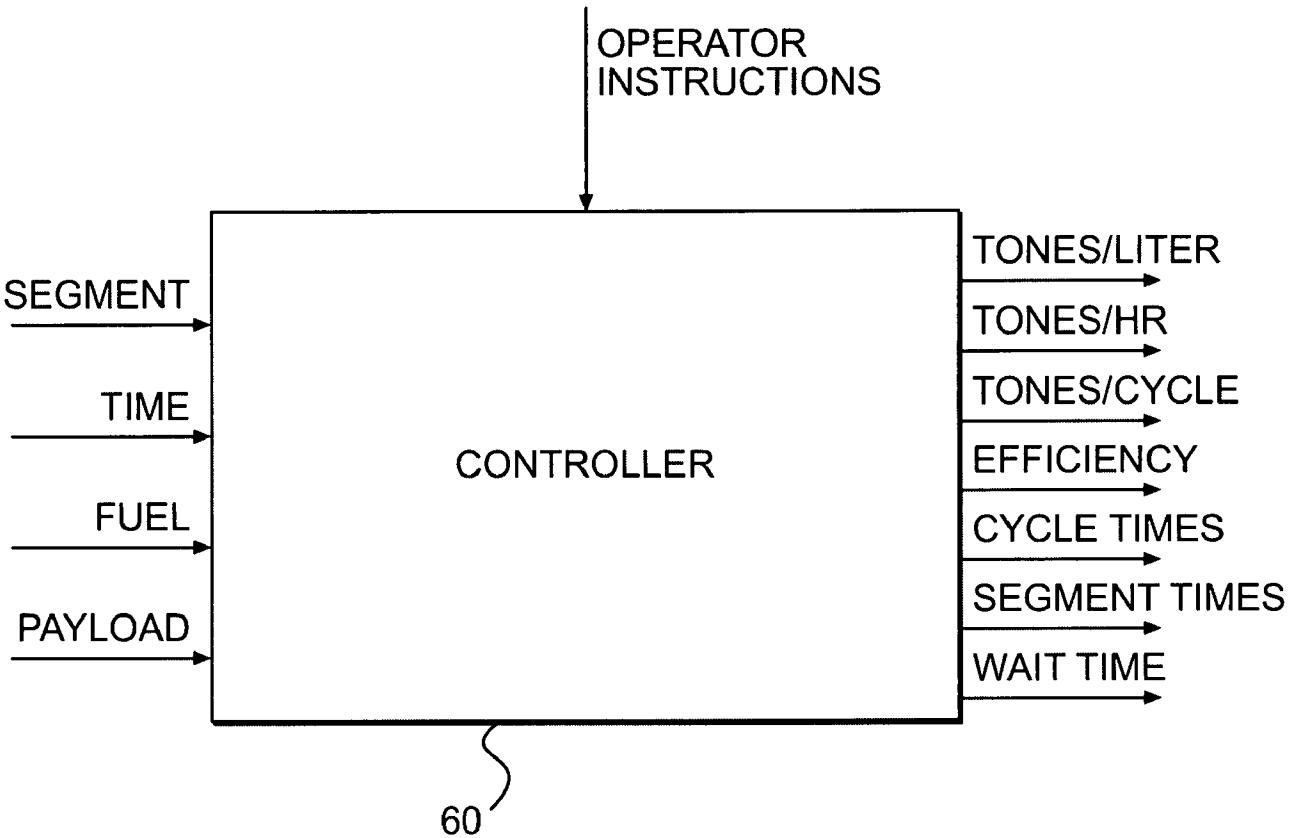
FIG. 5 is a control diagram illustrating an exemplary operation performed by the data acquisition system of FIG. 2.

As illustrated in FIG. 4, controller 60 may link machine performance, payload information, and power source performance to cycle segmentation information during post-processing. That is, during the operation of machine 10 and completion of the excavation work cycle, controller 60 may continuously record the signals from sensors 62A, 62B, 64, 65, 67, and 69. Based on the signals from sensors 62A, 64, and 65, controller 60 may segment the work cycle into four distinct segments. Based on signals from timer 30 and the segmentation, controller 60 may determine machine performance information associated with each of the segments (cycle time, segment time, etc.). Based on the signals from sensors 62B, 64, and 67, controller 60 may determine a payload of work tool 16. And, based on signals from sensor 69, controller 60 may determine a performance (e.g., fuel consumption) of power source 13. Controller 60 may link all of this information together, and index the information according to which segment of the work cycle was in process at the time the data used to generate the information was recorded.

For example, after completion of a first excavation work cycle, controller 60 may partition the cycle into a first dig segment, a first swing-to-truck segment, a first dump segment, and a first swing-to-trench segment. Controller 60 may also determine a time elapsed during completion of each of these segments and during completion of the entire excavation work cycle. In addition, controller 60 may determine a payload of work tool 16 and an amount of fuel consumed by power source 13 during each segment and during the entire cycle. Controller 60 may then link each segment to its respective completion time, payload, and consumed fuel amount.

Controller 60 may analyze the linked information according to operator request. Specifically, controller may utilize the timing, payload, and fuel consumption information for a particular segment or work cycle to determine a related performance parameter such as an amount of material moved per unit of fuel consumed (e.g., tones/liter); an amount of material moved per unit of time, per segment, or per cycle (e.g., tones/hr, tones/swing segment, tones/cycle, etc.); an efficiency of machine 10; and/or an idle time (i.e., wait time) of machine 10. The idle time may be considered the time during which the signals from sensors 62A, 62B, 64, 65, 67, and/or 69 indicate little movement of machine 10 or movement that can not be properly classified into one of the four segments. The operator may request specific performance parameters via an onboard interface device (e.g., computer console) that is hard wired to controller 60, via a portable device such as a laptop computer or PDA that is selectively connected to controller 60, and/or via a remote system that is wirelessly connected to controller 60. The different performance parameters may be selected from a list of available parameters and/or defined by the operator.

Controller 60 may also be configured to alert an operator of machine 10 when the linked performance parameters for at least one of the plurality of segments deviate from a threshold performance level. That is, the operator may establish the threshold performance level expected from machine 10 during each work cycle and/or during each segment of each work cycle. During post processing, controller 60 may compare the actual performance parameters to the threshold performance parameters and, based on the comparison, alert the operator when the actual performance of machine 10 is less than expected. It is contemplated that the threshold performance levels may, alternatively, be automatically generated based on the average performance parameters recorded during previous work cycles (e.g., based the average performance parameters from a particular segment of multiple previously executed work cycles).

INDUSTRIAL APPLICABILITY

The disclosed data acquisition system may be applicable to any excavation machine that performs a substantially repetitive work cycle, where knowledge about the performance of the machine during particular segments of the excavation work cycle is important. The disclosed data acquisition system may link the performance parameters to particular segments of the work cycle during which the associated information was recorded. The disclosed data acquisition system may also analyze the information according to operator request and established performance thresholds.

Several benefits may be associated with the disclosed data acquisition system. For example, by indexing the performance parameters according to work cycle segmentation, an operator or analyst might be able to retrieve information specific to a particular segment, a particular type of segment, a particular work shift, a particular work cycle, etc. In addition, the operator or analyst may be able to easily compare the performance of machine 10 during one segment, one type of segment, one work cycle, one work shift, etc. to another.

It will be apparent to those skilled in the art that various modifications and variations can be made to the disclosed data acquisition system. Other embodiments will be apparent to those skilled in the art from consideration of the specification and practice of the disclosed data acquisition system. It is intended that the specification and examples be considered as exemplary only, with a true scope being indicated by the following claims and their equivalents.

What is claimed is:

1. A data acquisition system for an excavation machine having a power source configured to drive a tool through repeated excavation work cycles during operation of the machine, the data acquisition system comprising:

a plurality of sensors including:

a first sensor associated with the power source to generate a first signal indicative of a performance of the power source;

a second sensor associated with the tool to generate a second signal indicative of a performance of the tool; and a controller in communication with the plurality of sensors, the controller being configured to:

record the first and second signals;

partition an excavation work cycle of the repeated excavation work cycles into a plurality of segments based on signals from at least one of the plurality of sensors, each segment of the plurality of segments being indicative of a separate task performed by the machine during the excavation work cycle;

identify a set of qualified samples for at least one segment of the plurality of segments of the excavation work cycle from the recorded second signals, the qualified samples being a set of the recorded second signals in the at least one segment having a swing velocity of the tool within a user-defined range; and compute the performance of the power source and the performance of the tool separately for the at least one segment of the excavation work cycle, the performance of the tool being computed using the identified qualified samples.

2. The data acquisition system of claim 1, wherein:

the performance of the power source is a fuel consumption of the power source.

3. The data acquisition system of claim 1, wherein the performance of the tool is a payload moved by the tool.

4. The data acquisition system of claim 3, wherein the controller is further configured to calculate a payload moved by the tool per completed excavation work cycle.

5. The data acquisition system of claim 1, wherein the controller is further configured to calculate an amount of fuel consumed during each segment of the plurality of segments of the excavation work cycle.

6. The data acquisition system of claim 1, further including a timer, wherein the controller is in communication with the timer and further configured to record an elapsed period of time taken to complete each segment of the plurality of segments.

7. The data acquisition system of claim 1, wherein the controller is configured to link the performances of the power source and the tool together with the one of the plurality of segments after the tool has completed the excavation work cycle.

8. The data acquisition system of claim 1, wherein the controller is further configured to:

compare the performances of the power source and the tool for each of the plurality of segments to a threshold performance level; and alert an operator of the excavation machine when the performances for at least one of the plurality of segments are below the threshold performance level.

9. A method of acquiring data in a machine having a power source that is configured to drive a tool through repeated excavation work cycles during operation of the machine, comprising:

generating a power output;

directing the power output to the tool to perforin an excavation work cycle of the repeated excavation work cycles;

sensing a plurality of parameters of the machine, including:

sensing a first parameter indicative of a performance of the power source;

sensing a second parameter associated with a performance of the tool during the excavation work cycle;

recording the first and second parameters;

partitioning the excavation work cycle into a plurality of segments based on at least one of the sensed plurality of parameters, each segment of the plurality of segments being indicative of a separate task performed by the machine during the excavation work cycle;

identifying a set of qualified samples for at least one segment of the plurality of segments of the excavation work cycle from the recorded second parameters, the qualified samples being a set of the recorded second parameters in the at least one segment having a swing velocity of the tool within a user-defined range; and computing the performance of the power source and the performance of the tool separately for the at least one segment of the excavation work cycle, the performance of the tool being computed using the identified qualified samples.

10. The method of claim 9, wherein:

the first parameter is related to a fuel consumption; and the second parameter is related to an amount of material moved during the excavation work cycle.

11. The method of claim 10, further including calculating an amount of material moved per amount of fuel consumed to move the material.

12. The method of claim 10, further including calculating an amount of fuel consumed during each of the plurality of segments.

13. The method of claim 10, further including calculating an amount of idle time during the excavation work cycle.

14. The method of claim 9, further including recording an elapsed period of time required for completion of each segment of the plurality of segments, and associating the elapsed period of time to complete each segment with the performance of the power source and the performance of the tool of that segment.

15. The method of claim 9, further including:

comparing the performance of the power source and the performance of the tool for each segment of the plurality of segments to threshold performance levels; and alerting an operator when the compared performance parameters for at least one segment of the plurality of segments are below the threshold performance level.

16. An excavation machine, comprising:

a combustion engine configured to generate a power output;

a plurality of sensors configured to measure operating parameters of the machine, including:

a first sensor associated with the combustion engine to generate a first signal indicative of a fuel consumption of the combustion engine;

a second sensor associated with an excavation tool of the machine to generate a second signal indicative of a payload moved by the tool;

a tool driven by the power output to move through repeated excavation work cycles during operation of the machine; and a controller in communication with the first and second sensors, the controller being configured to:

record the first and second signals;

partition the excavation work cycle into a dig segment, a loaded swing segment, a dump segment, and an empty swing segment based on readings from at least one sensor of the plurality of sensors;

identify a set of qualified samples for at least the loaded swing segment from the recorded second signals, the qualified samples being a set of second signals measured when a swing velocity of the tool is within a user-defined range; and determine the fuel consumption of the combustion engine and the payload moved by the tool for at least the loaded swing segment, the payload moved by the tool for at least the loaded swing segment being computed using the identified qualified samples.

17. The excavation machine of claim 16, wherein the controller is further configured to calculate at least one of:

a payload moved by the tool per amount of fuel consumed by the power source; and a payload moved by the tool per completed work cycle.

18. The excavation machine of claim 16, further including a timer, wherein the controller is in communication with the timer and further configured to record an elapsed period of time required for completion of each of the dig, loaded swing, dump, and empty swing segments.

19. The data acquisition system of claim 1, wherein the qualified samples include a set of second signals that start and end at about the same swing velocity.

20. The method of claim 9, wherein the qualified samples include a set of second parameters that start and end at about the same swing velocity.

* * * * *